US005380193A

United States Patent [19]

Williams et al.

[11] Patent Number: 5,380,193

[45] Date of Patent: Jan. 10, 1995

[54] APPARATUS FOR ATTACHING MANIFOLD ASSEMBLY TO GAS CONTROL ASSEMBLY OF FURNACE

[75] Inventors: Tommie L. Williams, Indianapolis; Matthew Kujawa, Danville, both of Ind.

[73] Assignee: Carrier Corporation, Syracuse, N.Y.

[21] Appl. No.: 160,900

[22] Filed: Dec. 2, 1993

[51] Int. Cl.[6] ..... F23C 5/08

[52] U.S. Cl. ..... 431/178; 431/343; 126/110 R

[58] Field of Search ..... 126/110 R, 116 R, 116 A; 431/178, 343

[56] References Cited

U.S. PATENT DOCUMENTS 3,425,781 2/1969 Bitterlich ..... 431/178
3,638,636 2/1972 Marshall et al. ..... 126/110 R
5,324,194 6/1994 Bruce et al. ..... 126/116 R

*Primary Examiner*—Carroll B. Dority

[57] ABSTRACT

In a gas-fired furnace of the type having a manifold assembly, comprising a gas valve, a manifold, orifices extending from the manifold and located on a common line, and a gas control assembly having a burner box compartment, the improvement comprises an apparatus for attaching a manifold assembly to the burner box compartment. The apparatus comprises a plurality of brackets, each bracket being affixed to the manifold at a position essentially 180° from the common line of orifices, and essentially perpendicular to the common line; each end of the bracket is retained near opposite side of the opening of the burner box compartment, and one end of each bracket is affixed to the side wall of the burner box.

8 Claims, 2 Drawing Sheets

APPARATUS FOR ATTACHING MANIFOLD ASSEMBLY TO GAS CONTROL ASSEMBLY OF FURNACE

BACKGROUND OF THE INVENTION

1. Field of the Invention

This invention relates to furnaces and, more particularly, to an improved apparatus for attachment of the manifold assembly to the gas control assembly of a furnace.

2. Description of the Prior Art

Typically in a gas fired furnace, fuel enters the system through a pipe and then passes through a manifold assembly that includes the manifold, gas valve and orifices which together function to regulate and direct the flow of gas to the burners where the gas is ignited. The manifold assembly is located inside the burner box compartment which is part of the gas control assembly. The manifold assembly attaches to the burner box for stability and to prevent undue stress on the manifold assembly components.

In the prior art, the manifold assembly was attached to the burner box compartment of the gas control assembly via a rather complex construct. This construct required the use of a non-standard shaped bracket and six screws, at least some of which were not easily accessible from the front of the burner box compartment.

However, this complex attachment construct resulted in considerable time being needed for the removal of the manifold assembly, or its installation inside the burner box compartment. One or both of these operations are required when the furnace is assembled, if the manifold needs servicing or replacement and, in about ten percent (10%) of furnace installations, when the furnace must be converted in the field from using natural gas as a source of fuel, to using propane as a source of fuel.

In the prior art furnaces the operation of replacement of the manifold assembly took at least fifteen (15) minutes. The process was difficult, in addition to being time consuming, as relatively inaccessible areas inside the burner box compartment had to be reached in order to release some of the six (6) screws that attached the manifold assembly to the burner box compartment. It was desired to provide an attachment scheme that allows orifice replacement in under five (5) minutes, needs few fasteners such as screws, and requires no special tools to execute.

SUMMARY OF THE INVENTION

It is therefore a primary object of the present invention to provide an apparatus for mounting a manifold assembly to a gas control assembly that allows for fast and easy installation and replacement of the manifold assembly.

It is a further object of the present invention to provide an apparatus for mounting a manifold assembly to a gas control assembly that allows replacement of the manifold assembly in under five minutes.

It is another object of the present invention to provide an apparatus for mounting a manifold assembly to a gas control assembly that requires the removal and replacement of only two screws during replacement of the manifold assembly.

It is yet a further object of the present invention to provide an apparatus for mounting a manifold assembly to a gas control assembly that allows replacement of the manifold assembly without having to access locations that are relatively inaccessible in the burner box.

These and other objects of the present invention are attained, in a gas-fired furnace of the type having a manifold assembly, comprising a gas valve, a manifold, orifices extending from the manifold and located on a common line, and a gas control assembly having a burner box compartment, by an improvement comprising an apparatus for attaching a manifold assembly to the burner box compartment. The apparatus comprises a plurality of brackets, each bracket being affixed to the manifold at a position essentially 180° from the common line of orifices, and essentially perpendicular to the common line; each end of the bracket is retained near opposite side of the opening of the burner box compartment, and one end of the bracket is affixed to the side wall of the burner box.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
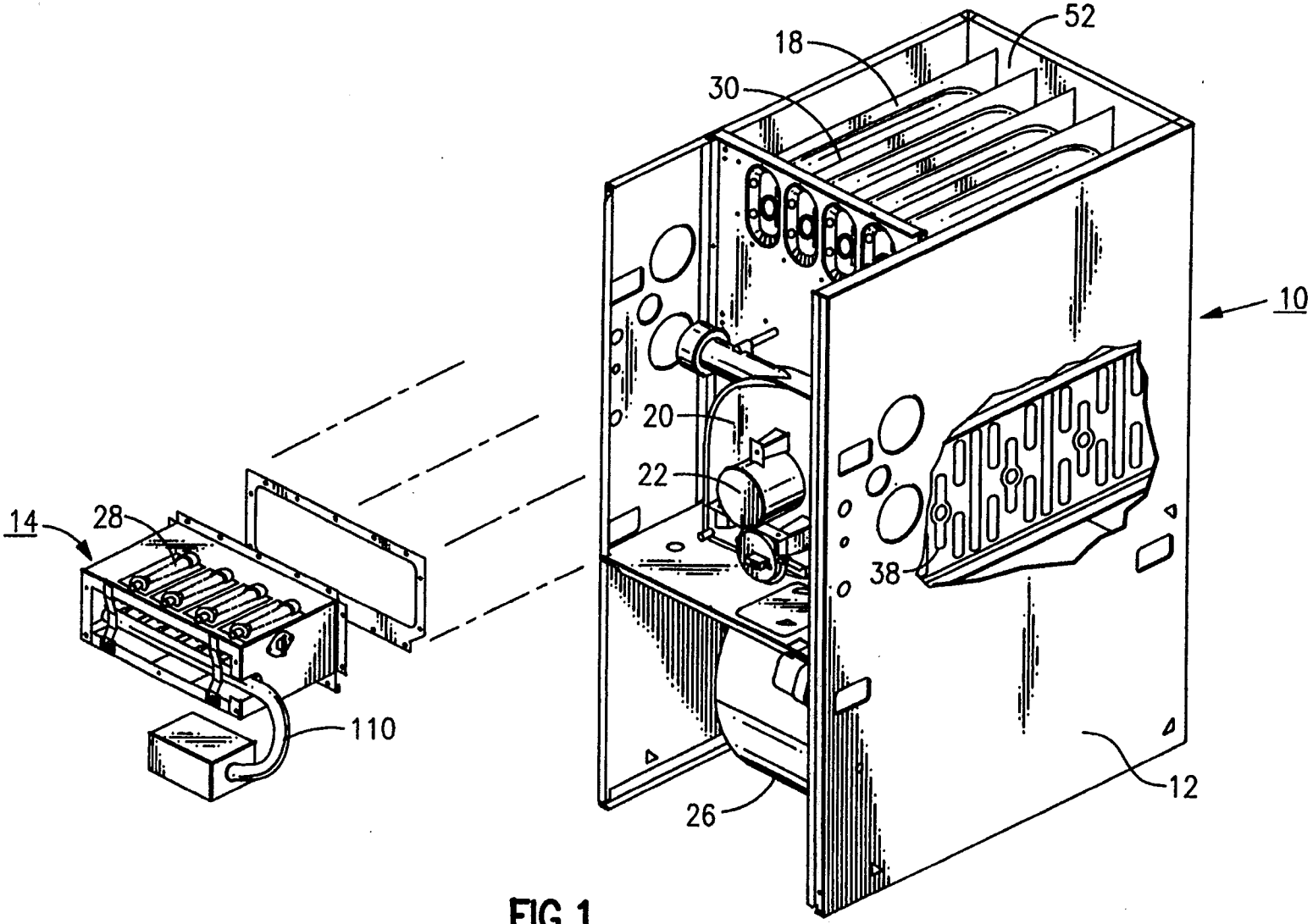
FIG. 1 is a partially broken-away side elevational view of a furnace incorporating the principles of the present invention.
Figure 2:
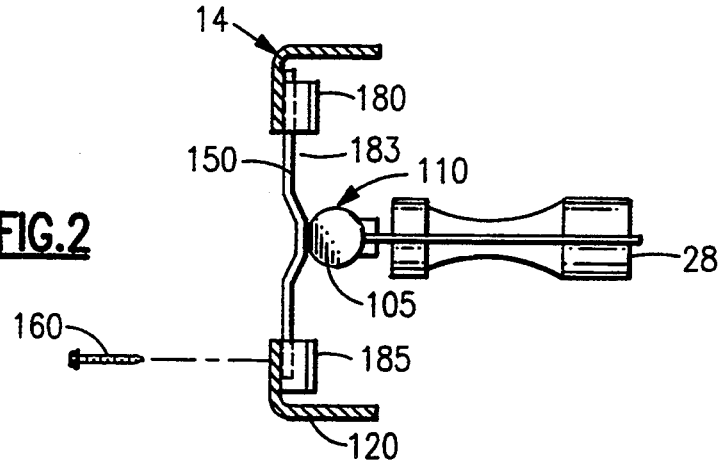
FIG. 2 is a side view of the apparatus of the instant invention showing the burner box and the apparatus attaching the manifold assembly thereto according to the instant invention, with the manifold assembly partially attached.
Figure 3:
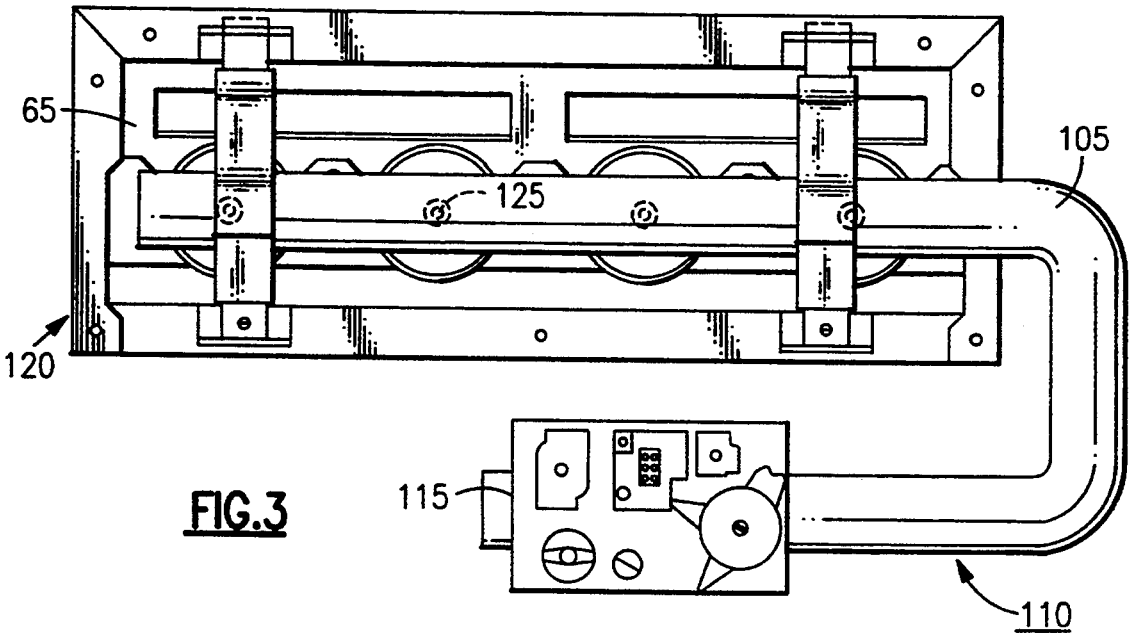
FIG. 3 is a back view of the invention of FIG. 2.

Turning now to the drawing and particularly, FIG. 1 thereof, there is illustrated a gas-fired furnace which may be operated according to the principles of the present invention. The following description is made with reference to condensing furnace 10, but it should be understood that the present invention contemplates incorporation with a non-condensing type furnace. Condensing furnace 10 includes in major part steel cabinet 12, housing therein burner assembly box 14, combination gas control (not shown), heat exchanger assembly 18, inducer housing 20 supporting inducer motor 22 and inducer wheel (not shown), and circulating air blower 26. The combination gas control includes burner ignition circuitry for controlling and proving the burner ignition.

Burner assembly 14 includes at least one inshot burner 28 for at least one primary heat exchanger 30. Burner 28 receives a flow of gas from the manifold assembly and injects the fuel gas into primary heat exchanger 30. Part of the injection process includes drawing air into heat exchanger assembly 18 so that the fuel gas and air mixture may be combusted therein. A flow of combustion air is delivered through combustion air inlet (not shown) to be mixed with the gas delivered to burner assembly 14.

Primary heat exchanger 30 includes an outlet (not shown) opening into a chamber (not shown). Connected to this chamber and in fluid communication therewith are four condensing heat exchangers 38, only one of which is shown, having an inlet and an outlet (both not shown). The outlet opens into a chamber (not shown) behind inducer housing 20, for venting exhaust flue gases and condensate.

Inducer housing 20 is connected to this chamber and has mounted therewith inducer motor 22 with inducer wheel for drawing the combusted fuel air mixture from burner assembly 14 through heat exchanger assembly 18. Air blower 26 delivers the air to be heated through air passage 52 and over heat exchanger assembly 18. The cool air passing over condensing heat exchangers 38 lowers the heat exchanger wall temperature below the dew point of the combusted fuel air mixture causing a portion of the water vapor in the combusted fuel air mixture to condense, thereby recovering a portion of the sensible and latent heat energy. The condensate formed within heat exchangers 38 flows through the chamber behind inducer housing 20 into a drain tube and to the condensate trap assembly (both not shown). As air blower 26 continues to urge a flow of air to be heated across heat exchanger assembly 18, heat energy is transferred from the combusted fuel air mixture flowing through heat exchangers 30 and 38 to heat the air circulated by blower 26. Finally, the combusted fuel air mixture that flows through heat exchangers 30 and 38 exits through an outlet (not shown) and is then delivered by inducer motor 22 through an exhaust gas outlet and thence to a vent pipe (both not shown).

Turning now to FIGS. 2–5, it can be seen that the gas manifold assembly 110 comprises the gas valve 115, the gas manifold 105, orifices 125 125, and a pair of manifold brackets 150 150. The manifold 105 is attached to the brackets 150 150 in such a way as not to create an intrusion through the manifold surface as, for example, by welding. The site of attachment is 180° opposite the line along which are located orifices 125 125 through which gas is directed toward the burners for combustion. There is one orifice 125 corresponding to each burner 28, and the orifices are all positioned colinearly. Each bracket 150 is aligned essentially perpendicularly to the axis of the manifold 105 in the region of the bracket, as well as to the common line of orifices 125, and is attached to the manifold at approximately the bracket center.

Each bracket 150 is shaped as an elongated rectangle and is comprised, preferably of corrosion resistant metal. Near the bottom 165 of each bracket 150 is a screw hole 155. The brackets 150 150 are retained interior the opening 65 to burner box compartment 120. On its top 160, each bracket is held between the burner box compartment 120 and an inner lip 180 thereof, there being slots 183 183 between the burner box compartment 120 and lip 180 through which brackets 150 150 extend. On its bottom 165, each bracket 150 is also slipped between an inner lip 185 and the wall of the burner box compartment 120. However, on the bottom each bracket attachment is stabilized by the insertion of screw 160 through corresponding screw hole 155 in each bracket and sheet metal gripper hole 140 in the burner box inner lip 185. The lips 180 185 and the corresponding burner box compartment opening sides from which the lips extend, are both essentially parallel to the line of orifices, with the lips being offset from the plane of the opening 65, being behind it.

Figure 4:
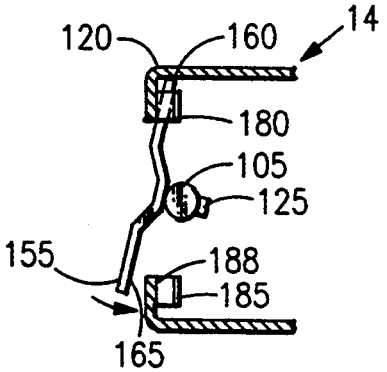
FIG. 4 is a side view of the invention of FIG. 2 showing the manifold partially attached to the burner box.
Figure 5:
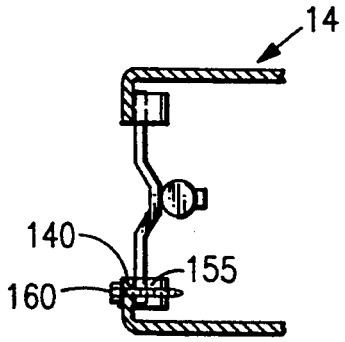
FIG. 5 is a side view of the invention of FIG. 2 with the manifold assembly completely attached.

In practice, then as is best shown in FIG. 4, the manifold assembly 110 can be installed quite simply. The gas manifold assembly 110 is positioned inside the burner box 14 and any necessary interior attachments (not shown) are performed. Then the tops 160 160 of both brackets 150 150 are slipped simultaneously into the slots 183 183 between lip 180 and burner box compartment 120. Next the bottoms 165 165 of the brackets 150 150 are inserted into the gap between lip 185 and burner box compartment 120. Finally, the bottom of each bracket is secured with screw 160. The entire process can be carried out without the necessity of reaching inside the burner box opening 65. The two screws 160 160 are set into place from the exterior of the box, making disconnection and/or connection a swift and simple process.

While this invention has been explained with reference to the structure disclosed herein, it is not confined to the details set forth and this application is intended to cover any modifications and changes as may come within the scope of the following claims:

What is claimed is:

1. In a gas-fired furnace of the type having a manifold assembly, said manifold assembly comprising a gas valve, a manifold, orifices extending from said manifold and being located on a common line, and a gas control assembly having a burner box compartment, the improvement comprising:

an apparatus for attaching a manifold assembly to the burner box compartment, comprising:

a plurality of brackets, each bracket being affixed to a manifold at a position essentially 180° from the common line of orifices, and being essentially perpendicular to said common line;

a first retaining means located on a first side of an opening of said burner box compartment, said first side being essentially parallel to said common line of orifices, for retaining a first end of said brackets to said first side;

a second retaining means located on a second side of an opening of said burner box compartment, said second side being essentially parallel to said common line of orifices, for retaining a second end of said bracket to said second side; and an affixing means for affixing said bracket to at least one of the group consisting of said first retaining means and said second retaining means.

2. The apparatus of claim 1 wherein said brackets are metal and have an elongated rectangular shape.

3. The apparatus of claim 1 wherein said first and second retaining means each comprises a slot disposed between its respective burner box compartment side and a lip which is essentially parallel to and offset from a plane of said burner box opening.

4. The apparatus of claim 1 wherein said affixing means comprises at least one screw.

5. The apparatus of claim 1 wherein said affixing means exists on only one side of said retaining means.

6. The apparatus of claim 5 wherein said affixing means exists only on said bottom retaining means.

7. The apparatus of claim 1 wherein said brackets are welded to the manifold.

8. A method of installing a gas manifold assembly into a burner box in gas-fired furnace, said manifold assembly being attached to a plurality of brackets, comprising the steps of:

positioning the gas manifold assembly inside the burner box;

sliding top ends of said brackets into slots adjacent a first side of an opening in said burner box;

inserting bottom ends of said brackets behind lips adjacent a second side of an opening in said burner box; and fastening one end of each of said brackets to said burner box.

* * * * *